US005528563A

United States Patent [19]

Tothill et al.

[11] Patent Number: 5,528,563

[45] Date of Patent: Jun. 18, 1996

[54] AUTOMATIC PARKING COUPON

[75] Inventors: Thomas W. Tothill; Harry G. Cockburn, both of Christchurch, New Zealand

[73] Assignee: John Compton Tothill, Pullenvale, Australia

[21] Appl. No.: 278,576

[22] Filed: Jul. 20, 1994

Related U.S. Application Data

[62] Division of Ser. No. 838,779, Mar. 18, 1992, abandoned.

[30] Foreign Application Priority Data

Sep. 20, 1989 [NZ] New Zealand ..... 230716

[51] Int. Cl.[6] ..... G07C 1/30; G04F 1/02

[52] U.S. Cl. ..... 368/327; 368/90

[58] Field of Search ..... 368/327, 90, 89

[56] References Cited

U.S. PATENT DOCUMENTS 3,620,677 11/1971 Morison ..... 116/114

4,137,049 1/1979 Couch et al. ..... 368/323

4,229,813 10/1980 Lilly et al. ..... 368/89

4,298,115 11/1981 Bradlet et al. ..... 368/323

*Primary Examiner*—Bernard Roskoski

*Attorney, Agent, or Firm*—Jones & Askew

[57] ABSTRACT

A timer comprising a lamination containing a piece of porous wick material 1, and a reservoir of liquid 6, said liquid 6 and/or said porous wick 1 being such that when the reservoir is opened and the liquid 6 released it soaks into the porous wick 1 to thereby create a visible trace of the liquid on or in the porous wick; a face part 2 of the lamination being transparent such that said visible trace can be seen; said wick material 1 having imposed thereon or positioned adjacent thereto a series of markings which cover the time range over which the timer is to be used. The invention also provides a method of manufacturing the timer.

17 Claims, 1 Drawing Sheet

AUTOMATIC PARKING COUPON

This is a division of application Ser. No. 07/838,779, filed Mar. 18, 1992 now abandoned.

The present invention relates to a timer for visibly indicating elapsed time and more particularly to a timer for visibly indicating elapsed time in such a manner that, once the timer has been started, it cannot be reset, slowed or otherwise tampered with. The timer according to the invention is capable of a wide variety of different applications, but is particularly useful as a substitute for existing parking meters.

A number of prior proposals have been made for substitute parking meters. One example being a timer comprising a case containing a piece of porous sheet material and a reservoir of liquid arranged so that when the liquid reservoir is opened liquid soaks into the paper. The liquid and/or paper being coloured or impregnated with a dye so that the passage of the liquid up or down the paper leaves a visible trace. The device functions as a timer because the rate of progress of the liquid up or down the paper is dependent upon time.

None of the existing proposals appear to have dealt successfully with inherent difficulties imposed on such a timer by temperature fluctuations. The rate of movement of the liquid up or down the porous sheet material depends on the viscosity of the liquid and the viscosity of the majority of liquids is normally temperature dependent. A number of proposals have been made to overcome this problem but none seem to have been entirely successful.

It is therefore an object of the present invention to provide a device of the above general type which obviates the above identified disadvantages and accurately compensates for viscosity fluctuations due to changes in temperature while not unduly increasing the complexity or cost of the timer device.

According to a first aspect of the present invention there is provided a timer comprising a lamination containing a piece of porous wick material, and a reservoir of liquid, said liquid and/or said porous wick being such that when the reservoir is opened and the liquid released it soaks into the porous wick to thereby create a visible trace of the liquid on or in the porous wick; a face part of the lamination being transparent such that said visible trace can be seen; said wick material having imposed thereon or positioned adjacent thereto a series of markings which cover the time range over which the timer is to be used.

According to a second aspect of the invention there is provided a method of manufacturing the timer according to the first aspect of the invention.

Preferably the porous wick is paper or a substrate at least partially coated with a porous plastics material (e.g. methylhydroxyethylcellulose) or plaster of paris.

Preferably the porous wick is encased in a layer of impervious material for example a polypropylene or polyester film. Across the bottom section of one of the laminated films is an opening through the film and above this is a band of aluminium foil or a line of hot melt adhesive which is bonded to the film. The lamination has attached to the back thereof a third laminate which is sealed around its edges thus forming a cavity between the laminates. This cavity has sealed therein a volume of fluid. The paper wick is preferably pre-coated on the back side with a solution consisting of a viscosity correction agent and a dye. Operation of the preferred timer device is described below.

Further aspect of the invention which should be considered in all its novel aspect will become apparent from the following description.

The present invention will now be described with reference to the accompanying drawings in which.

Figure 3:
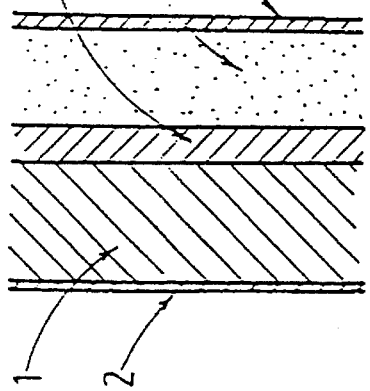
FIG. 3 shows a section on the lines A—A through the ticket shown in FIG. 1.
Figure 4:
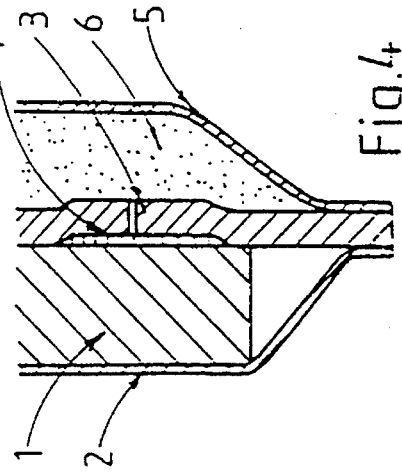
FIG. 4 shows a section on the lines B—B through the ticket shown in FIG. 1.
Figure 2:
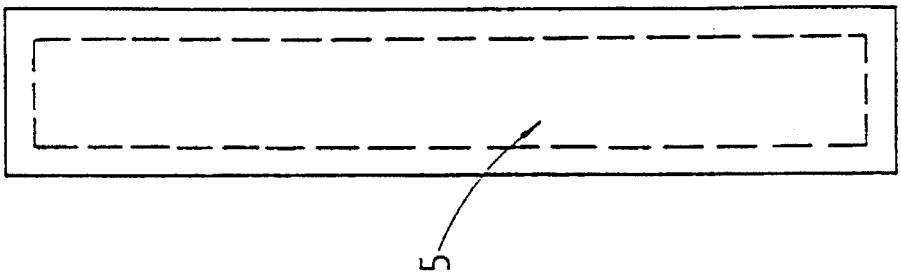
FIG. 2 shows a rear view of the ticket shown in FIG. 1.
Figure 1:
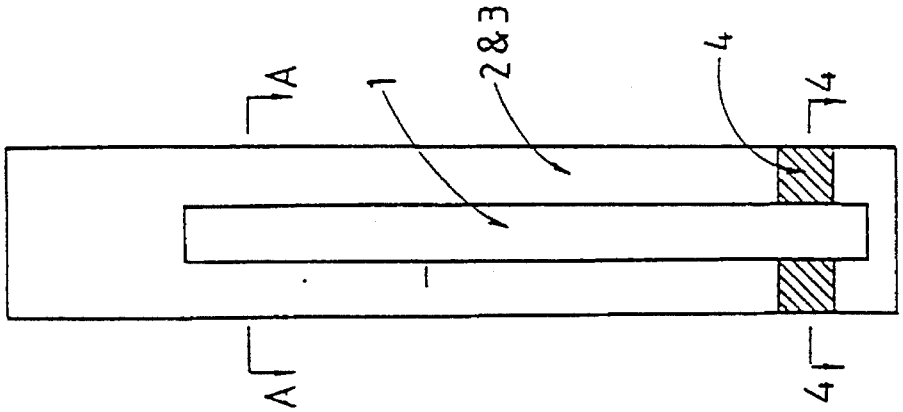
FIG. 1 shows a front view of a preferred example of timer ticket.

The following example of the timer device will be described with reference to the production of a parking meter coupon and it is to be appreciated that the same technology can be utilised in other situations.

The coupon consists of a porous paper wick 1 encased in layers of impervious film material, front and back 2 and 3 respectively. This covering film material can be a hot melt glue coated or co-extruded polyester film. The layers of film 2 and 3 are laminated together around their periphery. Across the bottom section of the film 3 there is an opening through the centre film and above this is a band of aluminium foil, polyester strip or hot melt trace 4 which is bonded by a hot melt glue to the centre film 3 on the wick side.

Attached to the back of the centre film 3 is a third film 5 that is sealed around its edges thus forming a cavity between the laminated films 3 and 5. Within this cavity is sealed a volume of fluid 6.

The paper wick element 1 is pre-coated on its back surface facing film 3 with a solution consisting of a viscosity correction agent and a dye.

The specification for the materials that have been found in the applicant's trials and experiments to be most suitable are;

a) Front film 2—clear co-extruded or hot melt adhesive coated polyester film of 12 micron thickness.

b) Middle film 3—aluminium metallized polyester film or co-laminated aluminium foil between polypropylene or polyethylene films to provide necessary water vapour impermeability and high bond strength.

c) Paper wick element 1—for time of ½ hour, 1 hour and 2 hour duration paper of 150 $g/m_2$ comprising 80% hardwood and 20% softwood pulp, with no filler, no sizing or other additives but with a density of 500 to 550 $Kg/m^3$; and for times above 2 hours to about 8 hours paper of 160 $g/m_2$ comprising 100% softwood pulp with a density of 700 $Kg/m^3$. The viscosity correction agent used on the surface of the element 1 or wick is material such as an aqueous solution of high molecular weight fraction gelatine with coloured dye such as rhodamine impregnated part way into the thickness of the paper wick.

d) Aluminium foil 4—standard commercial 15 micron aluminium foil, with a lacquer coating or hot melt glue coating to prevent water vapour transmission through any pin holes.

e) Fluid 6—an aqueous solution of calcium chloride and potassium chloride to give the required freezing point depression, viscosity correction agent solubility and hindered gelling properties.

f) Back film 5—aluminium metallized polyester film of 25 micron thickness or similar vapour barrier film to provide necessary water vapour impermeability.

The ticket when laminated together is activated by rupturing, pulling, puncturing or positively breaking a seal which is ruptured by movement associated with the generally flexible timer. This rupturing allows the fluid 6 to flow through the slit or holes in the film.

As the fluid 6 is drawn up the paper wick 1 by capillary action the dye is drawn to the front of the paper, thus indicating the fluid height up the wick.

The solubility of the viscosity correcting agent (VCA) is dependent on the fluid temperature, such that at differing temperatures, or over changing temperatures, the viscosity of the fluid and dissolved VCA remains relatively constant.

As the main variable affecting the rate that the fluid front progresses up the paper wick, is viscosity variation of the fluid, with temperature, thus dissolving of the VCA provides a rate of fluid migration up the paper wick that is comparatively unaffected by temperature variations from environmental conditions. The elapsed time is indicated by the fluid front passing a height indication mark that is printed on the film, ticket or paper wick 2. The fluid will continue on past the height mark and hence gives an indication of the time passed the expiry time or in this case 'time over parked'.

The top flap of the ticket is designed to be folded over a car window and hung on the drivers side window.

A method of manufacturing the ticket requires the blotting paper to be coated with the VCA and dye solution, using a direct reverse roller coating printing operation or similar. Optionally the paper may be heated to 160°–170° C. for a controlled time to modify the VCA's solubility to that required to give a constant viscosity of the fluid as it travels up the paper. This modification is similar to that used in the photographic industry for the hardening of gelatine used in films.

The paper wick elements can be cut from a roll of treated paper, then positioned on the film 3.

To achieve this the film 3 is heated to make the adhesive coating slightly tacky, then the wicks are positioned on the film.

This film is then passed between heated rollers or over a heated plate where the top film 2 is laminated to the centre film.

The use of heat activated adhesives on both films and soft rubber heated rollers, means that the molten glue is pushed into all the gaps around the paper wick. The option is to use an aluminium foil, polyester strip or hot melt trace as a weir.

Directly after the heater rollers the lamination passes through cold soft rubber rollers to 'set' the adhesive.

The forming of the back pouch on the ticket, lamination and filling with the fluid, is an adaption of standard liquid sachet forming equipment.

One aspect not discussed in the above description is the incorporation of an air cavity in the upper portion of the paper wick 1. This cavity is necessary to provide accurate time measurement in the upper half of the wick.

The preferred version above has been designed to produce particular elapsed times and it is envisaged that by minor modifications and variations the ticket can be designed to provide for differing elapsed times to suit particular users requirements.

A particular example of the invention has been described herein by way of example and it is envisaged that improvements and modifications can take place without departing from the scope of the appended claims.

I claim:

1. A method of manufacturing a timer for use as a parking meter or an indicator of elapsed time, the method comprising the steps of:

applying a high molecular weight fraction of gelatin to only one face of a piece of porous wick material to modify the wicking characteristics thereof;

a laminating and encasing the piece of porous wick material between two impervious films such as polyester or polypropylene films while forming, with a third film disposed on one of the two films, a reservoir for liquid separated from the piece of porous wick material, so that said one film becomes a center film;

inserting in the reservoir an aqueous fluid including salts which act as viscosity correction agents and wherein the fluid gives a required freezing point depression and the viscosity correction agent gives a required solubility and gel hindering properties when the reservoir is opened and the fluid is released to soak into the porous wick to thereby create a visible trace of the fluid associated with the porous wick seen on a face part of the lamination which is transparent; and imposing in the vicinity of said wick material a series of markings which over the time range over which the timer is to be used; and positioning the reservoir in register with the wick material on the side of the center film remote from said wick material and forming in said center film a ruputurable seal separating the wick material from the fluid in the reservoir.

2. A method as claimed in claim 1, comprising the further steps of:

forming an opening across a bottom section of the center film; and bonding a band of hot melt adhesive to the wick and to the film above the opening.

3. A method as claimed in claim 2, comprising the step of laminating the third film to the laminate comprising the first two films, thus forming a cavity between the laminates, wherein the laminating of the third film comprises sealing around the edges of the third film.

4. A method as claimed in claim 2, comprising the further step of precoating the porous wick on a back side with a solution consisting of viscosity correction agent and a dye.

5. A method as in claimed in claim 4, comprising the step of sealing the laminates together by hot melt glue containing.

6. A method as claimed 5, comprising the step of making a front one of said two films as a clear film substantially 12 micron thickness.

7. A method as claimed in claim 4, comprising the step of making the center film of a composite laminate film to provide the necessary bond or seal strength and water vapour impermeability.

8. A method as claimed in claim 4, comprising the step of making the porous wick of paper of about 150 g/m$^2$ comprising about 80% hardwood and about 20% softwood pulp, with no filler, no sizing or other additives but having a density of approximately 500 to 550 kg/m$^3$, so that the porous wick operates for times of ½ hour, one hour, and two hours.

9. A method as claimed in claim 4, comprising the step of making the porous wick of paper of about 160 g/m$^2$ comprising 100% softwood pulp having a density of about 700 g/m$^3$ or greater, wherein the wick operates for times of about two hours to about eight hours.

10. A method as claimed in claim 1, comprising the step of impregnating a dye part way into the thickness of the porous wick.

11. A method as claimed in claim 1, comprising the step of placing above the opening a band aluminum foil, with a lacquer coating to prevent water vapor transmission through any pin holes.

12. A method as claimed in claim 1, comprising the step of making the third film of an aluminum metallized polyester film of about 25 micron thickness to provide water vapor impermeability.

13. A method as claimed in claim 1, comprising the step of using a direct reverse roller coating printing process to coat the wick material with the viscosity correction agent and dye solution.

14. A method as claimed in claim 13, comprising the step of modifying the gelatine by cross-linking agents so as to give a substantially constant viscosity to the fluid as the fluid travels up the wick material.

15. A timer manufactured in accordance with the method of claim 1.

16. A method as claimed in claim 4, comprising the step of sealing the laminates together by co-extrusion.

17. A method as claimed in claim 1, comprising the step of placing above the opening a bond of aluminum foil with a lacquer coating to prevent water vapour transmission through any pin holes.

* * * * *